US006430535B1

(12) United States Patent
Spille et al.

(10) Patent No.: US 6,430,535 B1
(45) Date of Patent: Aug. 6, 2002

(54) METHOD AND DEVICE FOR PROJECTING SOUND SOURCES ONTO LOUDSPEAKERS

(75) Inventors: Jens Spille, Hemmingen; Johannes Böhm, Hannover, both of (DE)

(73) Assignee: Thomson Licensing, S.A., Boulogne-Billancourt (FR)

( * ) Notice: Subject to any disclaimer, the term of this patent is extended or adjusted under 35 U.S.C. 154(b) by 0 days.

(21) Appl. No.: 09/297,912

(22) PCT Filed: Oct. 25, 1997

(86) PCT No.: PCT/EP97/05902

§ 371 (c)(1),
(2), (4) Date: May 7, 1999

(87) PCT Pub. No.: WO98/20706

PCT Pub. Date: May 14, 1998

(30) Foreign Application Priority Data

Nov. 7, 1996 (DE) ..... 196 46 055

(51) Int. Cl.[7] ..... G10L 13/00

(52) U.S. Cl. ..... 704/500; 704/225; 704/258; 381/92; 381/94.3; 381/56; 381/98; 381/94.7

(58) Field of Search ..... 381/92, 94.3, 56, 381/98, 94.7; 367/118–127; 704/225, 226, 258, 219, 500–504, 208

(56) References Cited

U.S. PATENT DOCUMENTS

| | | | | |
|---|---|---|---|---|
| 5,335,011 A | * | 8/1994 | Addeo et al. | 348/15 |
| 5,581,620 A | * | 12/1996 | Brandstein et al. | 381/92 |
| 6,130,949 A | * | 10/2000 | Aoki et al. | 381/94.3 |
| 6,192,134 B1 | * | 2/2001 | White et al. | 381/92 |

FOREIGN PATENT DOCUMENTS

| | | | |
|---|---|---|---|
| EP | 0036337 A | 9/1981 | H04S/5/00 |
| GB | 2151439 A | 7/1985 | H04R/3/12 |
| WO | WO81/03407 | 11/1981 | H04S/1/00 |
| WO | WO91/20167 | 12/1991 | H04S/5/00 |
| WO | WO96/20567 | 12/1995 | H04N/7/50 |

OTHER PUBLICATIONS

Patent Abstracts of Japan, vol. 96, No. 6., Jun. 28, 1996.
International Search Report dated Mar. 19, 1998.

* cited by examiner

*Primary Examiner*—Vijay B Chawan
(74) *Attorney, Agent, or Firm*—Joseph S. Tripoli; Frederick A. Wein

(57) ABSTRACT

For the purpose of spatial reproduction of an audio signal, the latter must be projected onto the positions of the existing loudspeakers. It is desirable in this case not to have to be fixed on a specific loudspeaker configuration for transmitting the audio signal. However, a problem here is that a multiplicity of possible combinations exists. In the method according to the invention, the sound sources (3) are interpreted as acoustic objects for the purpose of projecting them onto an arbitrary loudspeaker configuration (2). Here, an acoustic object consists in that in addition to the audio signal a sound source is assigned an item of spatial information which specifies a virtual, spatial position of the sound source. In order to reproduce an acoustic object, the spatial information of the sound source and the actual position of a loudspeaker are used to calculate the virtual distance from the sound source via the loudspeaker to the hearer (1). Before reproduction, separate processing (7, 8, 9) of the audio signal for each loudspeaker is then performed for each acoustic object.

13 Claims, 2 Drawing Sheets

METHOD AND DEVICE FOR PROJECTING SOUND SOURCES ONTO LOUDSPEAKERS

FIELD OF THE INVENTION

The invention relates to a method and a device for projecting sound sources onto loudspeakers in order, in particular, to permit spatial reproduction of the sound sources.

BACKGROUND OF THE INVENTION

It is known from the MPEG-2 Standard ISO 13818 to aim at a spatial representation by means of multichannel stereophony, also called surround sound, for audio reproduction. Six channels are provided in this case for the multichannel sound, of which three channels (left, centre, right) are arranged in space in front of the listener, two channels (left surround, right surround) are arranged in space behind the listener, and a sixth channel is provided for reproducing low-pitched tones for special effects. The sound channels are matrixed in order, on the one hand, to ensure reverse compatibility with MPEG-1 audio signals and, on the other hand, also to render satisfactory reproduction possible, if instead of a complete surround-sound loudspeaker configuration only a pair of loudspeakers are present. In this case, the calculated stereosignals are transmitted as MPEG-1-compatible stereosignal and the remaining signals as additional data.

SUMMARY OF THE INVENTION

It is the object of the invention to specify a method for spatial reproduction of virtual sound sources. This object is achieved by means of the method specified in claim 1.

It is the further object of the invention to specify a device for applying the method according to the invention. This object is achieved by means of the device specified in claim 8.

In order to reproduce an audio signal, the latter frequently has to be projected onto the positions of the existing loudspeakers. A few projections may be mentioned here by way of example:

a) The projection of a mono signal onto a pair of stereo loudspeakers.

b) The projection of a 3/2-signal (3 loudspeakers in front/2 loudspeakers behind) onto a 2/2 loudspeaker arrangement.

c) The projection of a signal with the position 3 m away, 30° left, 10° high onto a loudspeaker ring which comprises 8 loudspeakers at a distance of 2 m with a respective 45° spacing.

d) The projection of 2 sound sources in the room onto 2 loudspeakers.

It is desirable not to have to be fixed on a specific configuration for the transmission of an audio signal. However, the problem arises in this case that there is an unlimited number of possible combinations.

In principle, the method according to the invention for projecting sound sources onto loudspeakers consists in that the sound sources are interpreted as acoustic objects, an acoustic object consisting in that in addition to the audio signal a sound source is assigned an item of spatial information which specifies a virtual, spatial position of the sound source.

The audio signal is advantageously processed as a function of the associated item of spatial information in order to reproduce an acoustic object.

In this case, the spatial position of the loudspeakers is preferably additionally considered, the virtual distance of the sound source from the loudspeaker being calculated from the spatial information and the position of the loudspeakers, and separate processing of the audio signal for each of the loudspeakers being performed for an acoustic object.

It is, furthermore, advantageous when one or more of the following parameters are considered when processing the audio signals:

- amplitude attenuation, for example by damping or diffraction,
- a different propagation time for the various acoustic objects and loudspeakers,
- consideration of the dependence of the loudspeaker level on the spatial arrangement by means of the outer ear function.

In this case, the processing of the audio signals can be further improved when the frequency dependence of the parameters is also considered.

The mathematical functions required for considering the parameters such as, for example, an attenuation function are preferably transmitted and/or stored as a function of the distance and/or the angle of deflection.

It is particularly advantageous when the data of an acoustic object are stored and/or transmitted by means of a compressed data stream in accordance with the MPEG-4 Standard.

In principle, the device according to the invention for projecting sound sources onto loudspeakers consists in that an arithmetic unit is provided which calculates the distance of the virtual acoustic objects from the respective loudspeakers from an item of spatial information transmitted with the audio signal and the actual position of the loudspeakers.

In this case, a memory is preferably provided in which the respective loudspeaker positions and/or mathematical functions for considering parameters are stored.

It is advantageous to provide n×k actuators for n acoustic objects and k loudspeakers, an actuator carrying out processing of an audio signal with reference to one of the loudspeakers.

In this case, a frequency dependence of the parameters is preferably also considered by the actuators, the signals firstly being resolved into frequency bands by a split filter (10), the individual frequency bands then being processed individually, and the processed frequency bands subsequently being recombined by a merge filter (12).

It is particularly advantageous when the split filter and/or the merge filter are part of an audio decoder which is present in any case.

Furthermore, one or more directional microphones can preferably be provided which are used to measure the loudspeaker position.

The directional microphones are preferably integrated in a remote control.

DRAWINGS

Exemplary embodiments of the invention will be described with the aid of the drawings, in which.

EXEMPLARY EMBODIMENTS

Figure 1:
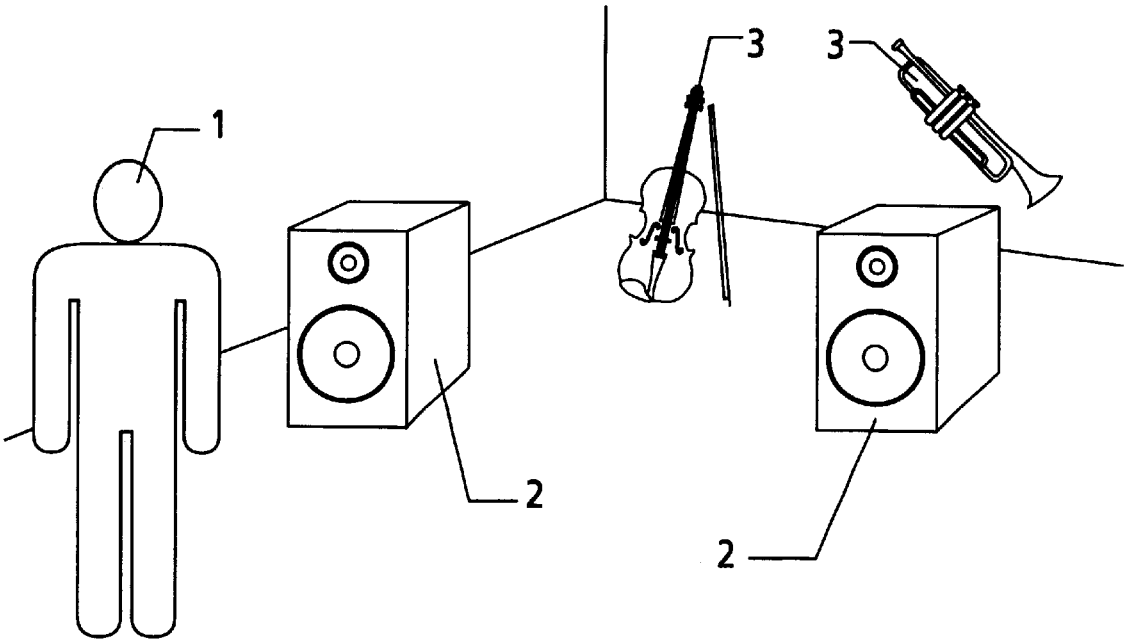
FIG. 1 shows virtual sound sources which are to be projected onto an existing pair of loudspeakers.

A typical problem arising is represented in FIG. 1. Two virtual sound sources 3, violin and trumpet, are to be projected onto an existing pair of loudspeakers 2 such that the listener 1 has the impression that the violin and trumpet are located in the spatial positions represented in FIG. 1.

A model can be developed for such a projection, and is based on the following observation: that a person be located in a room having a plurality of windows which are all open. That there be various sound sources outside the room, also termed acoustic objects below, such as street musicians, a car horn etc., for example. The person can locate the various sound sources effectively in acoustic terms, even if they are not visible. This is based on the fact that the sound paths through the various windows are different. The model described below is based on replacing each window by a loudspeaker. Given that the loudspeakers are correctly driven, the same sound field should result, and it should thus also be possible identically to locate the acoustic objects.

Figure 2:
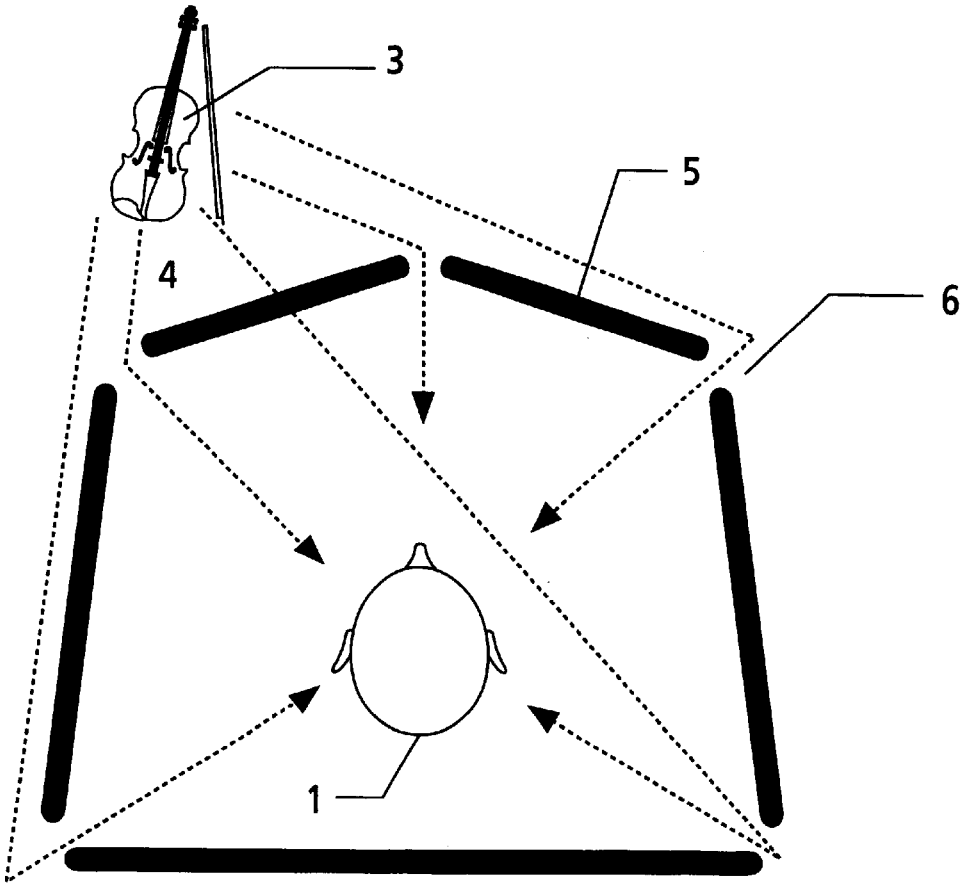
FIG. 2 shows the graphical representation of a model for calculating sound paths.

A graphical representation of the model is represented in FIG. 2. A listener 1 is located in an arbitrarily shaped room whose walls 5 consist of absorber material, with the result that no sound can penetrate from outside and no reflections are produced inside the room. The sound sources 3 are basically located outside the room. The loudspeakers or windows are taken into account by holes 6 in the wall of the room. This produces various sound paths 4 from the sound source 3 to the listener 1 through the various loudspeakers or window openings 6. The sound enters the room in this case through all loudspeakers or window openings, although each sound path has its own characteristics.

Figure 3:
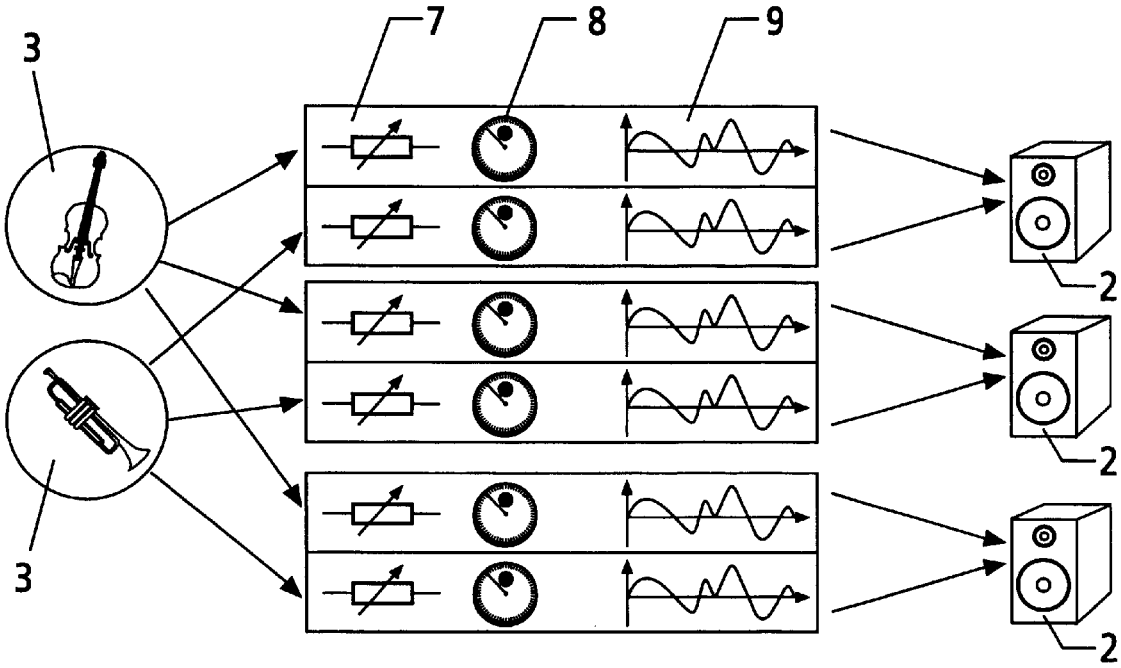
FIG. 3 shows the block diagram of a presentation circuit of the described model.

A presentation circuit in which the model is converted is illustrated in the block diagram shown in FIG. 3. Two acoustic objects 3, violin and trumpet, are projected in this case on the three existing loudspeakers 2. For each acoustic object the audio signals are now processed as a function of the virtual spatial position of this acoustic object and the actual position of each loudspeaker, in order to permit driving in accordance with the respective virtual sound path. In a generalization to n acoustic objects and k loudspeakers, this means that n×k actuators are used. In this case, one or more of the following parameters 7, 8, 9 are considered in each of the actuators in accordance with the virtual sound path. In order to drive the amplitude correctly, the latter must firstly be calculated as a function of the path length. In addition, consideration can also be given to attenuation or absorption by the air. Different functions can be considered in this case depending on the type of the sound source or the attenuation of the air. Thus, a spherical sound source loses its acoustic power with the square of the distance, that is to say the received power is given by the following formula:

$$\text{Received power } (r) := \text{transmitted power}/r^2$$

By contrast, a cylindrical sound source such as a train or a street, for example, looses its acoustic power only with the simple distance. The respective functions can be stored in this case in the presentation circuit, but can likewise be transmitted and stored with the signal. They can likewise be determined by the respective application or the user. In addition, it is also possible to consider diffraction which occurs at the loudspeakers or the window openings. In order to be able to consider these diffraction effects precisely, the diffraction would have to be calculated by the sum of all sound paths by means of a specific hole geometry, taking the frequency and phase into consideration. This gives rise, in approximate terms, to the fact that at low frequencies propagation takes place in all directions independently of the angle of incidence, while at higher frequencies the amplitude of the audio signal is a function of the angle between the entry to and exit from the respective hole. An approximate formula can be used to reduce the outlay on computation. Such a formula can also, as already described in the case of attenuation, be transmitted at the same time or be set by the application or the user. Since the diffraction effects depend on frequency, it would be necessary to consider this dependence on frequency in order to be able to calculate the diffraction attenuation exactly. In order to realize this in technical terms, it is necessary either to use filters with defined group delay times, or to resolve the signals into frequency bands and process them individually.

Figure 4:
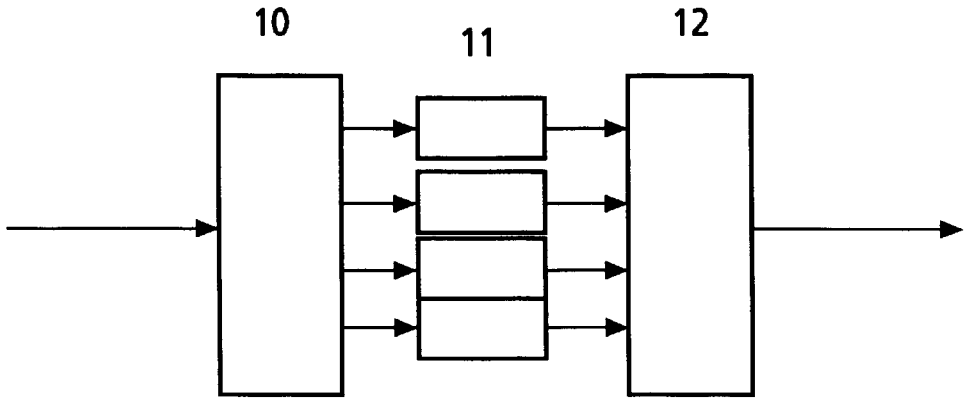
FIG. 4 shows a section of an audio decoder according to the invention.

As represented in FIG. 4, in this case the division could be performed by a split filter 10, subsequent to which processing would be performed by various actuators 11 and, finally, the processed signals would be recombined by a merge filter 12. This can be integrated particularly well into a typical audio decoder for MPEG, AC3 or ATRAC signals, since in their case processing is performed in the frequency domain and a split filter has already been provided for this purpose, with the result that there is no need to provide an additional split filter.

A further parameter is the propagation time (delay) of the signal. It holds here in principle that the sound wave first impinging on the ear is decisively involved in the perception of direction. For a path length r and a mean velocity of sound c of approximately 340 m/s, it holds as:

$$\text{Delay}(r) := r/c$$

In this case, the length r can be shortened by the shortest distance between the Loudspeakers and the listener. This reduces the storage requirement in the presentation unit.

There is a transfer function, also called the outer ear function, which is dependant on the direction and frequency, between a sound source and the human eardrum. In simple terms: the sound from the front is filtered differently by the ear muscles than the sound from behind.

The outer ear function should be considered if the desire is to radiate a virtual sound source, positioned at the angle x, by means of a loudspeaker which is provided at the angle z. This requires the differential level signal between the virtual and loudspeaker positions to be determined and the signal to be appropriately filtered. Since the outer ear function is not the same for all people, it is conceivable to enable the user to choose between different outer ear unctions for the purpose of a particularly good correction.

Here, as well, the filters can be realised by actuators in the frequency plane of an audio decoder.

The actual loudspeaker position must be determined in order to determine the path length between the virtual acoustic object and the actual loudspeaker position. Various methods are conceivable for this. Thus, the user could measure the space coordinates of the respective loudspeaker boxes using a meter rule or similar, and input the corresponding distance data into an input device which relays these data to the presentation circuit. The input can be performed here via a keyboard on the appropriate device, or a remote control, it also being possible, if appropriate, to monitor the input data or for the user to be guided by an on-screen display on a display device or on a viewing screen.

It is also possible to measure the loudspeaker system with the aid of one or more directional microphones, in order to save the user the mechanical measurement of the distances. The distance of the loudspeakers from the directional microphone or microphones can be determined in this case by reproducing via the loudspeakers a test sequence with pulses and by measuring the propagation time. The angles of the individual loudspeakers can then be determined via the directional characteristic of the directional microphones. It is then possible to measure the loudspeaker configuration automatically. In particular, it is self evident in this case to integrate the microphones in a remote control.

The entire virtual path length is then yielded from the position of the virtual acoustic object and, as described above, the position determined for the respective loudspeaker. Various possibilities of representation are conceivable in this case for the two positions. Thus, this can be performed, for example, by Cartesian coordinates, that is to say a specification of distance in all three directions in space, or by spherical coordinates, that is to say a specification of distance and the specification of the horizontal and, if appropriate, vertical angle.

While the position of the loudspeaker should remain unchanged in most cases, a change in the virtual position of the acoustic objects can by all means frequently occur. This will be the case, in particular, whenever the audio signals are reproduced in accompaniment with video signals. Thus, for example, in a feature film an actor or a vehicle can move on the viewing screen or disappear from the screen and thus change his spatial position. It is likewise conceivable that in computer games having sound outputs a game participant is moved by the player, for example with the aid of a joystick, and that the reproduction of a sound signal, which is assigned to the game participant, is adapted in accordance with the position prescribed or altered by the player.

The invention can be used to transmit, but also to record and reproduce digital audio signals, for example in accordance with the MPEG-4, MPEG-2 or AC3-Standards. This can be both pure audio signal reproduction, for example by a CD player, DAB or ADR receivers, and reproduction of the audio signals in conjunction with video signals, for example a DVD player or a digital television receiver. Furthermore, application is also conceivable in the case of interactive systems such as videophones or computer games.

What is claimed is:

1. Method for projecting sound sources onto loudspeakers, comprising:

receiving acoustic objects representing the sound sources, an acoustic object consisting in that in addition to the audio signal a sound source is assigned an item of spatial information which specifies a virtual, spatial position of the sound source;

calculating virtual distances between said sound sources and said loudspeakers using the item of spatial information for the respective sound source and a position information for the respective loudspeaker; and processing the audio signals of said acoustic objects as a function of the calculated virtual distances separately for each of the loudspeakers.

2. Method according to claim 1, characterized in that one or more of the following parameters are considered when processing the audio signals:

amplitude attenuation, for example by damping or diffraction, a different propagation time for the various acoustic objects and loudspeakers, consideration of the dependence of the loudspeaker level on the spatial arrangement by means of the outer ear function.

3. Method according to claim 2, characterized in that the frequency dependence of the parameters is also considered in processing the audio signals.

4. Method according to claim 3, characterized in that mathematical functions required for considering the parameters such as, for example, an attenuation function are transmitted and/or stored as a function of the distance and/or the angle of deflection.

5. Method according to claim 4, characterized in that the data of an acoustic object are stored and/or transmitted by means of a compressed data stream in accordance with the MPEG-4 Standard.

6. Device for projecting sound sources onto loudspeakers, comprising:

receiving means for acoustic objects representing the sound sources, an acoustic object consisting in that in addition to the audio signal a sound source is assigned an item of spatial information which specifies a virtual, spatial position of the sound source;

an arithmetic unit for calculating the distance of the virtual acoustic objects from the respective loudspeakers from said item of spatial information and the actual position of the loudspeakers; and n×k actuators for n acoustic objects and k loudspeakers, an actuator carrying out processing of the audio signal of an acoustic object as a function of the calculated virtual distance with reference to one of the loudspeakers.

7. Device according to claim 6, characterized in that an actuator contains at least one of the following units:

a unit for amplitude matching, a time-delay unit for correcting the different propagation times, a unit for considering the outer ear function.

8. Device according to claim 7, characterized in that a frequency dependence of the parameters is also considered by the actuators, the signals firstly being resolved into frequency bands by a split filter, the individual frequency bands then being processed individually, and the processed frequency bands subsequently being recombined by a merge filter.

9. Device according to claim 8, characterized in that the split filter and/or the merge filter are part of an audio decoder which is present in any case.

10. Device according to one of claim 6, characterized in that a memory is provided in which the respective loudspeaker positions and/or mathematical functions for considering parameters are stored.

11. Device according to one of claim 8, characterized in that one or more directional microphones are provided which are used to measure the loudspeaker position.

12. Device according to claim 11, characterized in that the directional microphone or the directional microphones is/are integrated in a remote control.

13. Method for projecting sound sources onto loudspeakers, comprising:

means for receiving acoustic objects representing the sound sources, an acoustic object consisting in that in addition to the audio signal a sound source is assigned an item of spatial information which specifies a virtual, spatial position of the sound source;

means for calculating virtual distances between said sound sources and said loudspeakers using the item of spatial information for the respective sound source and a position information for the respective loudspeaker; and means for processing the audio signals of said acoustic objects as a function of the calculated virtual distances separately for each of the loudspeakers.

* * * * *